US010048035B2

(12) United States Patent
Prater et al.

(10) Patent No.: US 10,048,035 B2
(45) Date of Patent: Aug. 14, 2018

(54) ARCHERY BOW

(71) Applicant: Grace Engineering Corp., Memphis, MI (US)

(72) Inventors: Scott C. Prater, Imlay City, MI (US); Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 15/683,182

(22) Filed: Aug. 22, 2017

(65) Prior Publication Data

US 2018/0094894 A1 Apr. 5, 2018

Related U.S. Application Data

(60) Provisional application No. 62/402,015, filed on Sep. 30, 2016.

(51) Int. Cl.
*F41B 5/10* (2006.01)

(52) U.S. Cl.
CPC ..... *F41B 5/10* (2013.01); *F41B 5/105* (2013.01)

(58) Field of Classification Search
CPC ..... F41B 5/10
See application file for complete search history.

(56) References Cited

U.S. PATENT DOCUMENTS 4,438,753 A * 3/1984 Simonds ..... F41B 5/105 124/25.6
5,335,645 A * 8/1994 Simonds ..... F41B 5/10 124/23.1
5,682,871 A * 11/1997 Walk ..... F41B 5/10 124/24.1
5,697,358 A * 12/1997 Campisi ..... F41B 5/10 124/23.1
5,921,227 A * 7/1999 Allshouse ..... F41B 5/105 124/25.6
8,079,353 B2 12/2011 Davis et al.
2014/0150762 A1 6/2014 McPherson

OTHER PUBLICATIONS

Hoyt Carbon Bow 2015.
Matthews Bow 2015.

* cited by examiner

*Primary Examiner* — John Ricci
(74) *Attorney, Agent, or Firm* — Warner Norcross + Judd LLP

(57) ABSTRACT

An archery bow is provided including a riser and cams configured to maintain alignment of the cams to decrease lateral or horizontal nock travel, and thereby increase overall accuracy. The riser can include a lower portion having a leg that flexes so that a lower cam of the bow moves laterally in a direction less than or equal to the amount an upper cam moves in the direction. The upper and lower cams can be sized differently, for example, with the upper cam including a longer bowstring payout track than the lower cam, to ensure consistent and appropriate nock travel. The riser and cams can facilitate placement of a center grip at the geometric center of the riser or between the limbs/cams. With such placement, the nocking point can be located above this geometric center. This can enhance the balance and feel of the bow. Related methods are also provided.

20 Claims, 8 Drawing Sheets

ARCHERY BOW

BACKGROUND OF THE INVENTION

The present invention relates to archery products, and more particularly to a riser and a cam system that maintain alignment and provide consistent, proper nock travel.

Conventional compound and crossbow archery bows include a bowstring and a set of power cables that transfer energy from the limbs and cams, eccentrics or pulleys (which are all referred to generally as "cams" herein) of the bow to the bowstring, and thus to an arrow shot from the bow. The cables and bowstring are strung from a cam on one limb to a cam on another limb. The power cables are guided by a cable guard in a lateral position relative to the bowstring so as to not interfere with movement of the bowstring or the travel of an arrow on the bowstring. The function of the cams is to provide a mechanical advantage so that energy imparted to the arrow is a multiple of that required of an archer to draw the bow.

Generally, there are single cam systems and dual cam systems, with various configurations of each. A single cam system usually includes a single cam mounted on one limb and a single track pulley mounted on the other limb of the bow. One dual cam system includes two cams, each mounted on opposing limbs of a bow. Two cables and a single bowstring are strung between both cams; however, one end of each cable is yoked to an axle upon which a cam rotates. Another variant of the dual cam system, often referred to as a binary cam system, has opposing power cables strung about both cams in respective take-up and payout tracks, and a bowstring strung in respective bowstring tracks in both cams. The upper and lower cams in this system usually are mirrored and identical in size and shape, so that the cams self-correct for timing and synchronization, and automatically equalize for imbalances in the bow.

Regardless of the type of cam system, they all work somewhat similarly. For example, when an archer draws the bow from an undrawn state to a drawn state, the bowstring rotates the cams rearward, and the force and energy applied by the archer to draw the bow is transferred to the limbs, typically bending the limbs so that they effectively store energy in their bent or flexed configuration. When the archer releases the bowstring, the energy stored in the limbs assists in rotating the cams and propelling the bowstring to its original position in an undrawn state.

In many conventional cam systems, as mentioned above, the power cables are held by a cable guard, laterally outward from the centerline of the bow and bowstring (when viewed from the rear of the bow), so as to keep the power cable out of the way of the bowstring and any nocked arrow. With the cables so laterally maintained, they exert a lateral force on the upper and lower cams. In turn, this pulls the tips of the respective limbs laterally as well, toward whatever side of the bow the cable guard is on. As a result, the limbs exert a moment on the riser where the limbs connect to the riser. If too much moment is applied, the riser twists slightly, which causes the upper and lower cams to move laterally out of alignment with one another and a centerline of the riser. This is unfavorable, as it throws off the alignment of those cams and their subsequent proper function. Generally, the lower portion of the riser has historically shown more twisting than the top.

Manufacturers have attempted to address this twisting of the riser near the limbs, and in particular, in the lower riser portion, by simply increasing the rigidity of the riser in the lower half of the riser so it will not twist as much. This typically is done by adding more material, such as more aluminum structure, in the lower half of the rise. What this does, however, is add weight and bulk to the bow, throws off its center of gravity, and does not adequately address the alignment of the upper and lower cams.

Further, most conventional compound bows are designed to have the arrow located at the geometric center of the riser and bowstring, which in turn promotes even vertical nock travel of the arrow. In turn, such bows are structured so that the grip of the riser, where the archer holds the bow, is located a large distance below the geometric center of the riser. As a result, such bows are top heavy, so they tend to tilt forward and feel unbalanced to some archers. This can in some cases affect arrow travel and overall accuracy of the bow.

SUMMARY OF THE INVENTION

An archery bow including a riser and a cam system configured to enhance or maintain alignment of the cams, which in turn can decrease lateral nock travel and thereby increase shooting consistency and overall accuracy.

In one embodiment, the riser can include an upper portion and a lower portion with a grip located therebetween. The riser can further include a central longitudinal axis which generally bisects the grip laterally into left and right portions. The lower portion can include a leg bowed outwardly in the same direction as the upper portion from the central longitudinal axis. The leg and lower portion can be configured to dynamically flex when the bow is drawn and shot so that the lower cam of the bow moves laterally in the direction less than or equal to the amount an upper cam moves in the direction. This generally can enhance and promote alignment of the cams along a vertical plane that passes through corresponding tracks in the upper and lower cams, which in turn can decrease lateral nock travel, for example, left/right lateral movement of nocking point on the bowstring as the bowstring is drawn and/or released during a shot.

In another embodiment, the riser includes a grip having an outer grip lateral surface that is spaced a distance in a first direction from the central longitudinal axis. The leg can include an inner leg lateral surface that is spaced another; greater distance in the first direction from the central longitudinal axis.

In yet another embodiment, the upper and lower cams can be sized differently. As an example, the upper cam can include an upper bowstring payout track and the lower cam can include a lower bowstring payout track. The upper track can be of a greater length than the lower track to minimize vertical nock travel, for example, up/down vertical movement of nocking point on the bowstring as the bowstring is drawn and/or released during a shot.

In a further embodiment, the riser and cams can be configured so that even with the nocking point of the bowstring above the geometric center of the riser, a difference in the upper track and lower track lengths can compensate for this offset from the geometric center and provide consistent and proper vertical nock travel.

In still another embodiment, the ratio of the lower cam payout track length to the upper cam payout track length can be less than 1:1. This ratio optionally can be in the range of 1:2 to 1:1.1, or it can be less than 1:1.1.

In even another embodiment, the riser and cams can facilitate placement of a center grip at, along or slightly above the geometric center of the riser or between the limbs/cams, optionally with the nocking point above that geometric center. This can enhance the balance and feel of the bow.

In still yet another embodiment, the upper and lower cams are configured so that the bowstring pays out from the upper bowstring track faster than the bowstring pays out from the lower bowstring track. This in turn allows the nocking point to travel, in a generally single plane, forward when the bow is shot, despite the offset of the nocking point from the geometric centerline.

In a further embodiment, the cams of the bow can include a power cable cam. The power cable cam can be configured to include a constant radius for a predetermined length of a power cable take-up track. For example, a portion of the first 1-4 inches of the take up track can, through a predetermined angle, be of a constant radius from the axis of rotation of the cam. This can maintain the cable under a higher tension for the first several inches of the draw stroke.

In yet a further embodiment, a method of using the archery bow is provided. The method can include providing a bow with the above components, and drawing the bowstring so that the power cable pulls laterally on the upper and lower cams, but the upper cam moves laterally toward a reference plane a first distance that is greater than or equal to a second distance by which the lower cam moves toward the reference plane.

The archery bow of the current embodiments, with its riser and cam system, can exhibit increased efficiency, exceptional lateral and/or vertical nock travel, a true center grip and enhanced accuracy. When included, the dynamic flexibility of the riser lower portion and leg actually enables the lower cam of the bow to move laterally less than or equal to the amount an upper cam moves laterally. In turn, this translates into less horizontal or lateral nock travel during the draw cycle and the shot cycle of the bow. More particularly, it is believed by the inventors that any movement in the riser can directly translate into movement of the cams and thus create unwanted lateral nock travel. For example, if one end of a riser twists in a direction due to lateral loading, for example, during drawing or shooting the bow, the limb assembly and cam will move accordingly. As a result, the lateral movement of the cam also will result in the bowstring and nocking point/nock to travel in a similar manner. With the current embodiments, the riser can be designed to exhibit minimal twisting motion in the ends of the riser to provide the significantly reduced horizontal or lateral nock travel during a draw cycle and/or a shot cycle. For example, placing an offset leg at a predetermined point on the lower portion of the riser can control movement precisely, and can induce a movement that counteracts the moment or twisting exerted on the riser during a shot cycle, and thus movement of the cams and associated lateral nock travel.

The discovered effects of increasing the flexibility of the lower riser portion to reduce lateral nock travel is surprising and the opposite of what is expected because conventional bows strengthen and make less flexible (more rigid) the lower riser portion in an attempt to add rigidity to the bow in hopes of aligning the upper and lower cams. While these strengthened bows have met some success, they are not nearly as beneficial as some of the current embodiments.

Further, where the upper cam track is of a greater length than the lower cam track, this can ensure consistent and appropriate vertical nock travel, even with a true center grip at, along or slightly above the geometric centerline of the riser, and the flocking point above the same. Where the center grip is at or slightly above the geometric centerline, the bow is provided with exceptional balance and feel. The center grip also can make the bow less prone to fall forward after the bow is shot.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
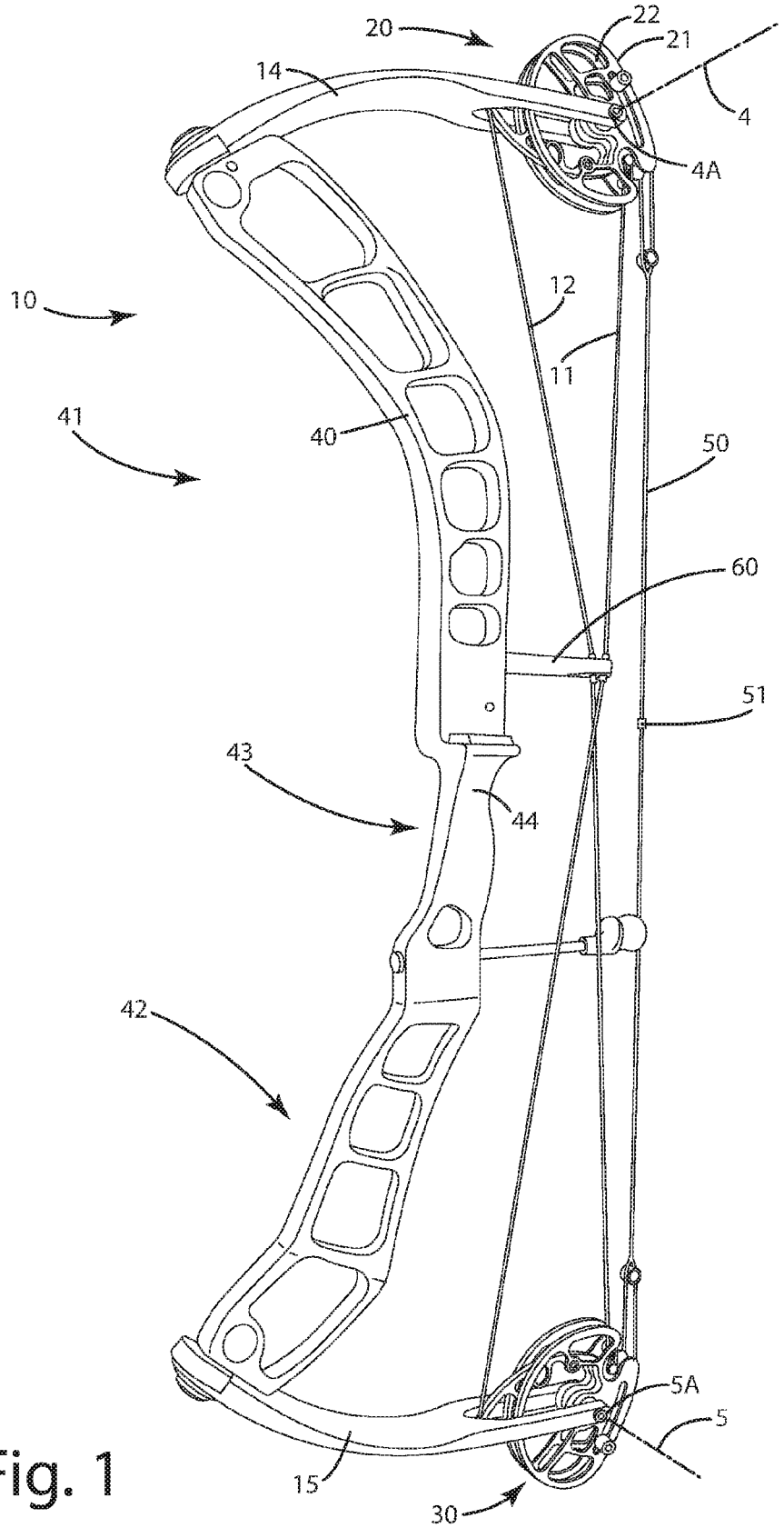
FIG. 1 is a rear perspective view of an archery bow including a riser and cam system of the current embodiment.

A compound archery bow including one or more cams including a riser and cam system in accordance with a current embodiment is illustrated in FIGS. 1-6 and generally designated 10. The cam system can include upper 20 and lower 30 cam bodies or assemblies, which can form a dual cam system on the bow 10. The upper cam body 20 can be mounted to an upper limb 14 and the lower cam assembly 30 can be mounted to the lower limb 15 of the bow 10. The upper and lower limbs can be joined with the riser 40 of the bow, and spaced apart from one another in a desired configuration. When the archery bow goes through a draw cycle (when an archer draws the bow) or a shot cycle (when the bowstring is released to propel an arrow from the bow) the riser and cams function to maintain alignment of the cams to promote minimal to zero lateral nock travel of the nocking point 51 of the bowstring 50 relative to a reference plane RP measured as distance NPD in FIG. 2. With the riser and cams of the current embodiments, the center grip 43 of the riser grip 44 can be placed at or slightly above the geometric centerline GCL as shown in FIG. 7. With this configuration, an archer can grip and hold the archery bow 10 a well-balanced configuration so that the bow draws with even forces from top to bottom, and so that when the bow is shot, it does not tip forward or rearward excessively. This can lead to improved shot placement and accuracy.

Although the current embodiment herein is described in connection with a dual cam bow, and in particular a binary cam system, the riser 40, cam assemblies 20, 30, bowstrings, cables and other features are suited for use with simpler pulley systems, for example, in single cam systems. The riser, cam assembly, bowstrings, cables and other features also can be used in other dual cam, cam and a half, and single cam systems as well. Further, the embodiments herein are well suited for compound archery bows, dual cam bows, cam and a half bows, crossbows and other archery systems including two or more cams. As used herein, a "cam" refers to a cam, a pulley, and/or an eccentric, whether a modular, removable part, or an integral part of a cam assembly, for use with an archery bow. However, when a cam is described as an "eccentric cam," this refers to a cam that rotates about an axis distal from a center of the body, for example a geometric center, and this term excludes perfectly circular pulleys such as those used in single cam archery bows. As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam assembly, for example, defined by a bowstring cam and or a power cable cam, and can be of virtually any geometric cross section, for example, partially or fully semi-circular, rounded, triangular, rectangular, square, polygonal, or combinations of the foregoing. The cam and/or module can be formed from rigid material, such as a metal, optionally aluminum, titanium, or magnesium, or a non-metal, optionally composites and/or polymers.

Figure 2:
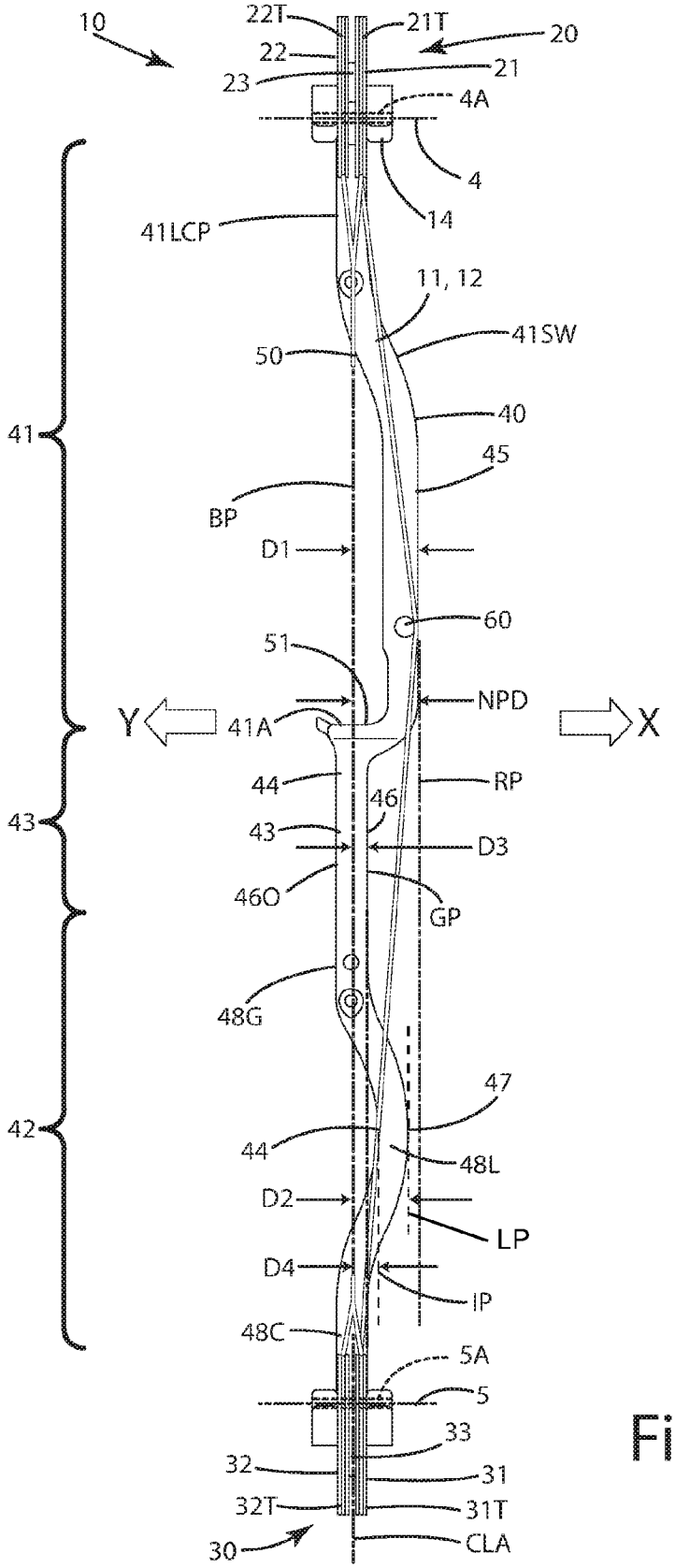
FIG. 2 is a rear view of the archery bow in a brace mode illustrating the offset of a lower riser portion.

As used herein, an "axis of rotation" refers to an axis about which a cam can and/or does rotate, for example, a upper axis 4 or a lower axis 5 of respective upper and lower cams 20 and 30 as shown in FIG. 2. These axes can coincide with the center of a respective axles 4A and 5A if desired. Although not described in detail, the cam assemblies herein can include modular elements that provide some level of adjustment of a performance characteristic of a bow, including but not limited to, a particular draw length, draw stop or draw force for the bow. The assemblies also can include draw stops and other components common to cams as desired.

Turning now to the current embodiment of the archery bow 10, the upper cam body 20 can optionally include a first bowstring cam 21 and a second bowstring cam 22, each including respective bowstring tracks 21T and 22T within which the bowstring or a portion of the bowstring are guided as the bow is drawn or shot in the cam rotates. Further, although not shown in significant can detail, the bowstring 50 itself can include a central or primary bowstring and bowstring portions that are disposed in the respective tracks of the bowstring cams. All of these components are collectively referred to as a bowstring herein. An example of this type of multi-part bowstring is disclosed in U.S. Pat. No. 9,453,698 to Grace.

The first and second bowstring cams can form the outer portions of the cam body 20. The cam parts 21, 22 can be identical to one another, with identical peripheral sizes and/or shapes. The cams can be generally perpendicular to the axis of rotation 4, and can be located in planes that are substantially parallel to the plane BP in which the bowstring is located when the bow is in its undrawn state, and/or in which the bowstring generally moves during its draw cycle and/or shot cycle. Of course, one of these bowstring cams 21 or 22 can be removed or deleted from the construction as desired. Further, although only two bowstring tracks are shown, additional bowstring tracks may be added. Generally, the collection of one or more bowstring cams 21, 22 and the power cable cam 23 can be referred to as the upper cam 20 herein. Likewise, the collection of bowstring cams 31, 32 and power cable cam 33 can be referred to as the lower cam 30 herein.

The bowstring cam parts 21, 22 can be in the form of individual cams that are joined together with one another, and optionally other elements such as a power cable cam 23, via fasteners such as screws, rivets, welds, and other fastening structures. Alternatively, the cam parts can be in the form of a monolithic, continuous single piece structure that includes the cam parts and the respective features thereof. The cam body 20 and its components can be constructed from a rigid metal, polymeric, and/or composite structure, and can have a generally volute peripheral shape. Optionally, the cam assembly can be machined from metal, such as aluminum, magnesium or titanium, metal injection molded, and/or formed from a composite material with suitable properties.

The upper cam 20 can be rotatably mounted on the limb 14 via an axle 4A that projects through an aperture defined by the upper cam 20. In general, the upper cam can be adapted to rotate about the axis of rotation. The axle 4A can be an integral part of the cam body, or can rotate with the cam body, or can be configured so that the cam body rotates about the axle. Optionally, the axle and/or limb can include suitable bearings to enhance rotation of the upper cam 20. Suitable bearings include, but are not limited to, bushings, roller bearings, and ball bearings.

The power cable cam 23 can be located between the first and second bowstring cams 21, 22, or adjacent a single bowstring cam if only one is included. The power cable cam 23 can be integrally formed and monolithic with one or more of the respective first bowstring cam 21 and second bowstring cam 22. Optionally, the power cable cam 23 can be fastened with fasteners as described above to the respective first bowstring cam part and second bowstring cam part.

Figure 6:
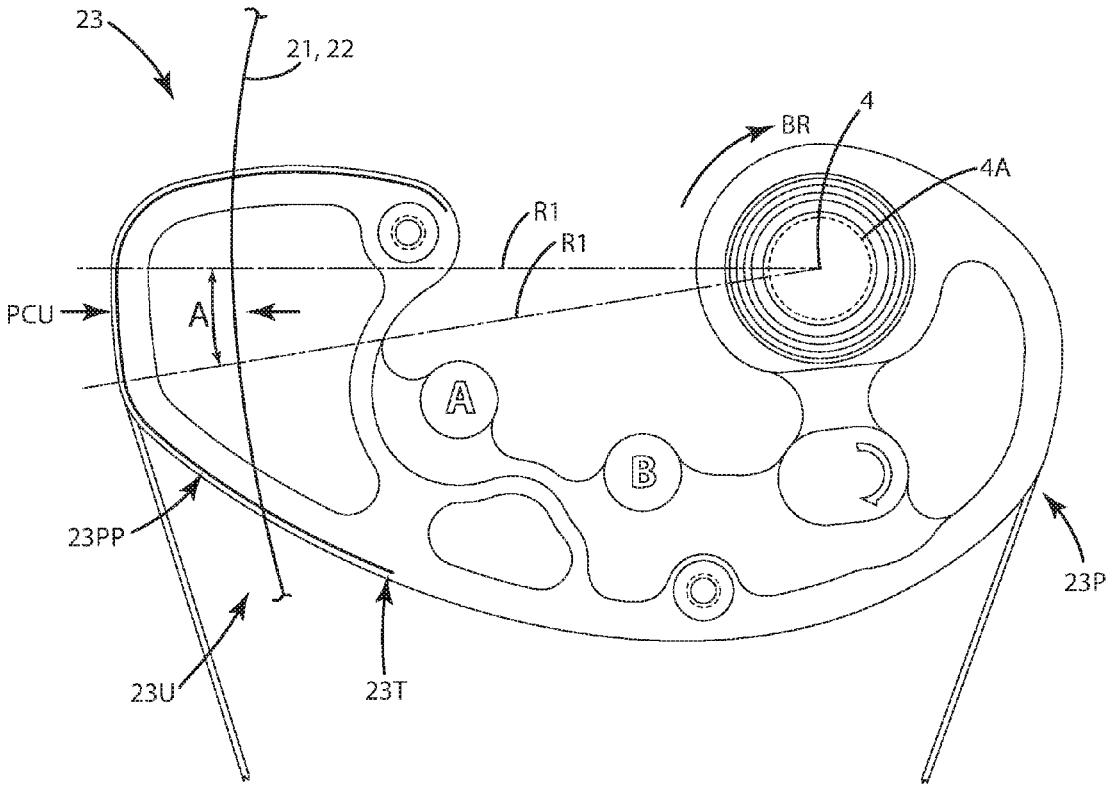
FIG. 6 is a side view of a power cable cam of the cams.
Figure 7:
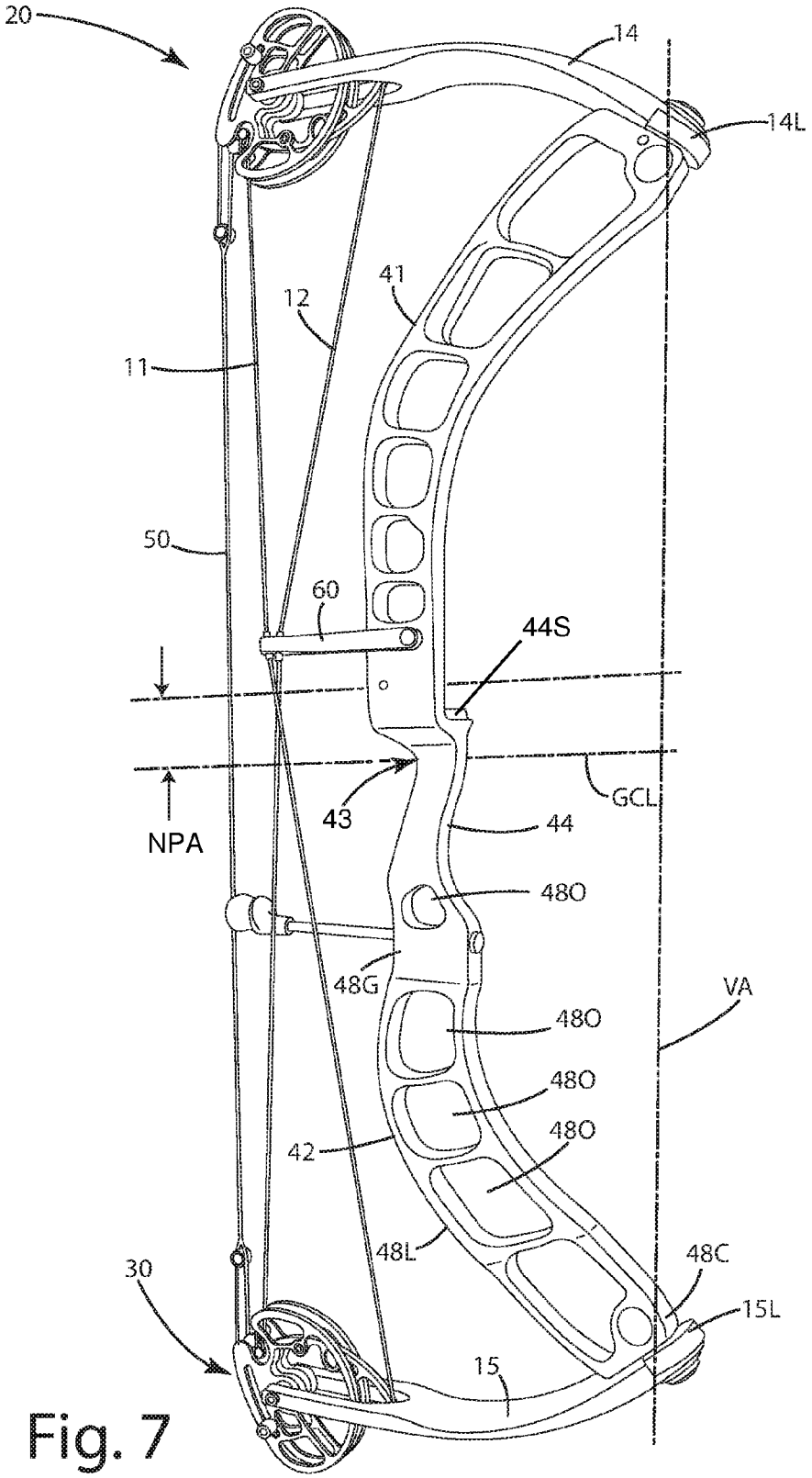
FIG. 7 is a side view of the archery bow illustrating a center grip at a geometric centerline of the riser and a nocking point above the geometric centerline.

As shown in FIG. 6, which shows the power cable cam 23 separated from the bowstring cams 21 and 22, the power cable cam 23 can define a power cable track 23T, which can be of the same geometric cross section as the respective bowstring cable tracks described further below. The power cable track 23 can include a power cable take up portion 23U and a power cable pay out portion 23P. The power cable let out portion and take up portion can be contiguous with one another and generally lay within the same power cable track as illustrated. One suitable cable track construction that accommodates different power cables is a single track power cable construction. The down cable 11 can be let out from the power cable pay out portion 23P when the archery bow 10 is drawn and the cam body 20 rotates about the axis 4 in the direction BR. Simultaneously and synchronously, the up cable can 12 be taken up by the take up track portion 23U in the power cable track 23T.

The power cable cam 23 of the current embodiments also can be configured in a particular manner to maintain the cable under higher tension for the first 0" to 5" of the draw stroke, when the bow is drawn from a brace mode to a drawn mode. This in turn can ensure that the bow achieves its peak draw weight sooner in the draw cycle. To implement this, certain portions of the power cable take-up track 23 can be constructed to follow a constant radius, circular arc about the axis 4 of rotation. As a more particular example, some predefined portion 23PP of the first 0" to 5", or 1" to 4" of the upper power cable cam cable take up track 23U can include a radius R1 that extends from the center of the axle 4 or from the axis of rotation 4, to the track 23U. This radius R1 can be constant for an angular range of optionally 5° to 20°, further optionally 7° to 15°, even further optionally 8° to 10°, and yet further optionally about 9°. In addition, the cams can be configured to provide generally linear vertical nock travel as the nocking point 51 of the bowstring is drawn rearward when an archer draws the bow from a brace mode to a drawn mode. In this case, the nocking point 51 can travel along a generally horizontal line as the bow is drawn.

The radius R1 further can be constant through the aforementioned angular range and/or angle A along a portion of the power cable cam 23 and/or the power cable cam track 23T that extends beyond the outermost periphery of the first and second bowstring cam parts 21 and 22, as shown in FIG. 6. There, the radius R1 can be greater than any radius R2 of the bowstring cam parts 21 and 22 taken from the axis of rotation for to the outermost periphery of those cam parts 21 and 22. The lower cam 30 can be similarly configured with the radius R1 of the power cable cam extending beyond the other radii R3, R4 of the bowstring cams 31, 32.

Although not described in particular detail, the lower cam assembly 30, also referred to as the lower cam, can include bowstring cam parts 31 and 32 with respective bowstring tracks 31T and 32T. The lower cam also can include a lower cam power cable cam 33. These components can generally be similar to the corresponding components of the upper cam 20, with a few exceptions as described in more detail immediately below and further below.

Figure 5:
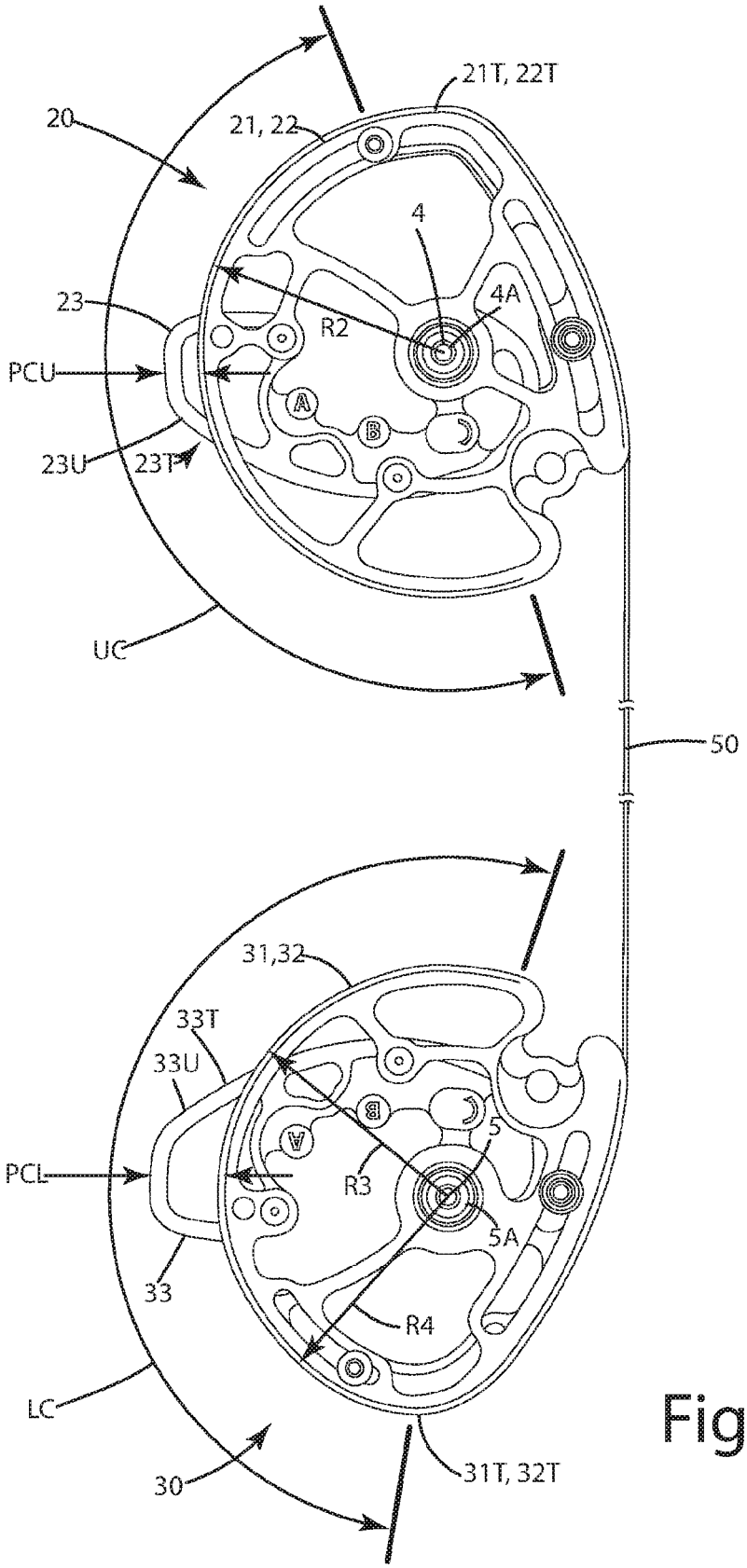
FIG. 5 is a side view of the upper and lower cams of the archery bow illustrating the differences between those cams.

For example, the lower power cable cam 33 can include at least a portion of a take-up track 33U that lies along a circular arc having a constant radius from the axis of rotation, along the above recited angles, like that of radius R1 of the power cable track 23T described above. However, due to the different sizes of the respective bowstring cam parts of the upper and lower cams 20 and 30, the power cable cam track 33T can extend beyond the outermost periphery of the first and second bowstring cam parts 31, 32 a distance PCL, which distance is different, e.g., greater than, the distance PCU by which the power cable cam track 23T of the upper cam extends beyond the outermost periphery of the first and second bowstring cam parts 21, 22, as shown in FIG. 5.

Optionally, although the upper 23 and lower 33 power cable cams are virtually identical to one another, having the same overall outer perimeter dimensions, due to the different sizes of the bowstring cam parts from the upper cam to the lower cam described further below, those respective upper and lower power cable cams project beyond the perimeters of the respective upper and lower bowstring cams different distances. As illustrated, the lower power cable cam 33 can extend a greater distance PCL than the distance PCU by which the upper power cable cam 23 extends beyond the bowstring cam 31, 32 perimeters.

Turning now to the riser 40 of the archery bow 10, it can be seen from FIGS. 1-2 and 7 that this riser is of a particular configuration. The riser 40 can be divided into three general sections, in particular an upper riser portion 41, a lower riser portion 42, and a grip 43 that joins the upper and lower riser portions. In this embodiment, the grip 43 is the only structure joining and extending between or otherwise connecting the upper riser portion 41 and the lower riser portion 42. Optionally, the riser can be void of any other buttresses, connecting bars, or lateral stability elements extending adjacent the grip, between the upper riser portion and the lower riser portion. Given the particularly good balance of this riser, such additional elements are not particularly useful. Of course, in some cases they can be added if desired.

The upper riser portion 41 can extend from a limb connecting portion 41LCP which is connected to the upper limb 14 via a limb bolt and/or cup (not shown). This upper limb connecting portion 41LCP transitions to a sight window portion 41SW that extends downwardly toward the grip 43. This sight window portion 41SW also extends laterally in a first direction away from the central longitudinal axis CLA of the riser 40. The central longitudinal axis CLA can generally be a line along a plane that bisects the grip 43 into left and right halves when viewed from a rear perspective view of the bow 10 as shown in FIG. 2.

The sight window portion 41SW can include an outermost upper lateral surface 45 which is spaced a first distance D1 in the first direction from the central longitudinal axis CLA. This outer upper lateral surface 45 can also define a reference plane RP that extends generally vertically and parallel to the bowstring plane BP as shown in FIG. 2. This reference plane RP can also be substantially parallel to the central longitudinal axis CLA, and the plane within which it lays. Optionally, the distance can be about 0.5 inches to about 5 inches, further optionally about 1 inch to about 3 inches, even further optionally about 1.5 inches to about 2.75 inches, and yet further optionally about 1.58 inches. Accordingly, the reference plane RP can lay this distance D1 from the bowstring plane as well.

The sight window portion 41SW can extend downward to an arrow shelf 41A at which point the riser extends back toward the central longitudinal axis CLA. Somewhere within the sight window portion 41SW, the riser can be joined with a cable guard 60. This cable guard can be configured to laterally displace portions of the power cables 11 and 12 in a lateral direction away from the bowstring plane BP and central longitudinal axis CLA. The cable guard 60 can hold and maintain these power cables laterally relative to the bowstring plane so that as the bowstring 50 moves within the bowstring plane, the power cables do not interfere with its movement or the movement of an arrow attached to the bowstring 50 at the nocking point 51. This cable guard 60 can maintain adequate clearance in that region where an arrow is propelled via the bowstring 50 relative to the power cables.

The cable guard 60, although not shown, can include several different types of cable guides the directly engage the power cables. These cable guides can be in the form of rollers, polished ceramic guides, low friction contact points along the cable guard and the like.

The archery bow shown in FIG. 2 is the form of a right-handed bow. In the case of a left-handed bow, the sight window portion for 41SW and outer upper lateral surface 45 can be spaced the distance in a second direction Y that is the opposite of the first direction X as explained above. Likewise, for a left-handed bow, the cable guard can pull the cables in a lateral direction Y, opposite from the lateral direction X in which the cable guard 60 pulls the cables 11 and 12 in direction X as shown in FIG. 2.

As mentioned above, and shown in FIG. 2, the upper riser portion 41 is joined directly with the grip 43. The grip 43 can include left and right portions that are bisected by the central longitudinal axis CLA. The grip can extend generally forwardly as shown in FIG. 7 up to a forward most grip point 43. The grip point 43 coincides with a location along the grip that is configured to engage in archer's hand, holding the bow, in a purlicue of the archer's hand, which is located between an archer's thumb and forefinger. The purlicue generally corresponds to the web of flesh tissue and muscle that extends between the forefinger and thumb.

Given the particular construction of the archery bow 10 of the current embodiments, and in particular the riser and cam systems, the forward most grip point 43 can be referred to as a center grip. This center grip 43 can be located at and/or along a geometric center line GCL of the riser 40 as shown. The geometric center line GCL can be located halfway between the first limb 14 and the second limb 15 and optionally can be below the riser shelf 44S. The geometric center line GCL also can be defined and located halfway between the respective limb pivots 14L and 15L. Optionally, a vertical axis VA can be drawn between the center points of the limb pivots 14L and 15L. The geometric center line GCL can be located precisely half the distance between those points. Further optionally, in some cases, the center grip can be located optionally 0.1" to 2" above the center line GCL, further optionally 0.25" to 1.5" above the center line GCL, even further optionally 0.25" to 1" above the center line GCL, or other distances above the center line, depending on the application.

In a more particular example, shown in FIG. 7, a ruler indicates that the distance between the centers of the limb bolt pivots 14L and 15L on VA can be about 26.5 inches. The geometric center line GCL of the bow therefore lays at 13.25 inches, half of the 26.5 inches. This geometric center line GCL can be substantially perpendicular to the central longitudinal axis CLA of the riser 40. With this configuration, the archer can engage the grip 43 with the archer's hand such that the purlicue between the archer's thumb and forefinger nestles within and directly engages the center grip 43 located at or along the geometric center line GCL of the riser. In effect, this can balance the upper and lower portions of the riser so that the riser is substantially less prone to tip forward or rearward during the draw cycle and/or the shot cycle.

With the center grip 43 placed adjacent the geometric center line GCL, however, the archers hand and arm obscure that location along the bowstring 50 for attachment of an arrow or location of a nocking point there. Accordingly, the nocking point 51 of the bowstring 50, that is, the location where an arrow is nocked on the bowstring, is disposed above the geometric center line GCL. As illustrated in FIG. 7, the nocking point 51 can be disposed distance NPA above the geometric center line GCL. In turn, this results in the portions of the bowstring 50 above and below the nocking point being unequal. Optionally, the portion above the nocking point extending to the upper cam 20 is shorter than the portion of the bowstring extending from the nocking point to the lower cam 30. With this construction, it can be helpful to modify the bowstring cam parts to pay out and take up the bowstring within those upper and lower parts at different rates or by different amounts so that the vertical nock travel of the nocking point 51 is substantially linear and consistent throughout the draw cycle and the shot cycle, which in turn, results in the arrow flying consistently when shot from the bow. This distance NPA can be about 0.5 inches to about 5 inches, further optionally about 0.75 inches to 4 inches, even further optionally about 1 inch to about 2 inches, even further optionally 1.5 inches to 2.5 inches, yet further optionally 2.0 inches. Other distances can be selected depending on the offset of the nocking point relative to the geometric center line, and the operation of the upper and lower cams.

Turning back to the riser 40 shown in FIG. 2, the grip 43 can include an outer grip lateral surface 46 that is spaced in the first direction X from a central longitudinal axis CLA of the riser 40. The outer grip lateral surface 46 can generally lie within a plane GP. The outer grip lateral surface 46 and its plane GP can be spaced a third distance D3 in the first direction X from the central longitudinal axis CLA. This distance D3 can be 0.25 inches to 1.0, or optionally about 0.5 inches. The grip can include an opposite grip lateral surface 460 that extends and is spaced in the direction Y from the central longitudinal axis CLA.

The riser 40 includes a lower riser portion 42 that extends downward from the grip. This lower riser portion 42 can comprise a grip portion 48G that extends downward from the grip 43 and is adjacent the grip. In this grip portion 48G, the riser can include one or more hollowed out, open spaces 480 as shown in FIG. 7. These open spaces 480 can extend downward throughout a portion of the lower riser portion 42 (as well as other portions of the riser). The grip portion 48G can transition to a leg 48L that extends from the grip portion 48G to a limb connecting portion 48C. The limb connecting portion 48C can include the limb pivot 15L as shown in FIG. 7. Other mechanisms can be used to join the limb connecting portion of the riser to the limb that will not be described here.

The lower riser portion 42 is bowed outwardly at the leg 48L. Specifically, the leg 48L can be bowed outward away from the central longitudinal axis CLA in the first direction X (for a right-handed bow, or direction Y for a left-handed bow). The leg can include an outer lower lateral surface 47 that defines or lays at least partially in or tangent to a leg plane LP. This outer lower lateral surface and or leg plane LP can be spaced a second distance D2 from the central longitudinal axis CLA in the plane within which it lays. As illustrated, the leg 48L bows outwardly in a curved manner relative to the grip portion 48G and the limb connecting portion 48C. In other structures and applications, the leg can bow outwardly in an angular manner, being in the shape of the U- or C-shaped channel, with optional corners and angles defined along the inner leg lateral surface 49, which itself can define a plane IP parallel tangent thereto. This inner leg lateral surface and its respective plane IP can be spaced a fourth distance D4 from the central longitudinal axis CLA and the bowstring plane BP.

In general, this fourth distance can be equal to or greater than the third distance D3 of the outer grip lateral surface from the central longitudinal axis. In this manner, the leg 48L can be said to extend laterally outward, beyond the outer grip lateral surface. Depending on the application, this can provide the flexibility to promote and minimize lateral nock travel as described further below. The inner leg lateral surface can be at least one of curved and/or angled outward away from the central longitudinal axis CLA.

As shown in FIGS. 1 and 2, the leg 48L can be the only structure of the riser 40 connecting the grip portion 48G and the limb connecting portion 48C of the riser. Put another way, there can be optionally no other structures extending between the grip or grip portion and the limb connecting portion, other than the leg. Optionally, there is no other portion of the riser extending in direction Y (at least for right-handed bow) from the grip portion 48G to the limb connecting portion 48C. Further optionally, there can be an absence of any other bars, elements, buttresses or connecting elements, other than the leg 48L, that extend between the grip or lower grip portion 48G and the limb connecting portion 48C. This can be helpful, as such additional structures can add rigidity to the leg and the lower riser portion 42 overall, which can be the opposite of what is intended via the leg, that is, to add flexibility to that region of the riser 40.

As mentioned above, the outer upper lateral surface is spaced a first distance D1 from the central longitudinal axis and generally lays with any reference plane RP. As further mentioned above, the outer lower lateral surface 47 of the leg 48L is spaced a second distance D2 in the first direction X (at least for a right-handed bow) from the central longitudinal axis CLA. The second distance D2 can optionally be about 0.5 inches to about 6 inches, further optionally about 1 inch to about 3 inches, even further optionally about 1 inch to 1.5 inches, and even further optionally about 1.38 inches. In some cases, making the distance D2 greater than the distance D1, this can increase flexibility, improve cam alignment and reduce lateral nock travel. Further benefits can be achieved when the distance D1 and D2 are in a particular ratio, for example, when the ratio of the first distance the second distance is in the range of optionally about 2:1 to about 1:1, further optionally about 1:1, even further optionally about 1:2 to about 1:1, yet further optionally about 1:2 to about 1:3, still further optionally about 1.5:1 to about 1:4. Of course other ratios can be selected depending on the particular configuration of the riser and the lower leg portion.

As mentioned above, it has been discovered that with the bowed out leg portion and the lower riser portion 42, the riser is able to dynamically flex during a draw cycle and during a shot cycle of the bow. Indeed, by manipulating the above ratios and configuration of the riser, as well as the general configuration of the leg, it is possible to control how the bottom of the riser moves to counteract the inherent motion and/or twisting exerted upon the cams by the laterally pulled power cables, which of course is transferred to the limbs and thus the riser. As a result, with the offset leg, the archery bow can be configured so that the deflections by the riser's upper and now lower riser portions cancel one another out. With this, the bow enables one to precisely control the amount that the bottom portion of the riser is twisted by adjusting the dimensions of the offset leg. Indeed, in some cases, material can actually be removed from the lower riser portion and the leg to enhance lateral nock travel. In addition, it is been discovered that the deflections caused by the lateral and torsional loading on the lower riser portion stays the same, regardless of the actual load on the riser. For example, alignment of the limbs and cams and thus the lateral nock travel can be maintained through both the draw cycle and the shot cycle. As a result, the archery bow 10 of the current embodiments can exhibit exceptional arrow flight, accuracy and consistency.

Figure 3:
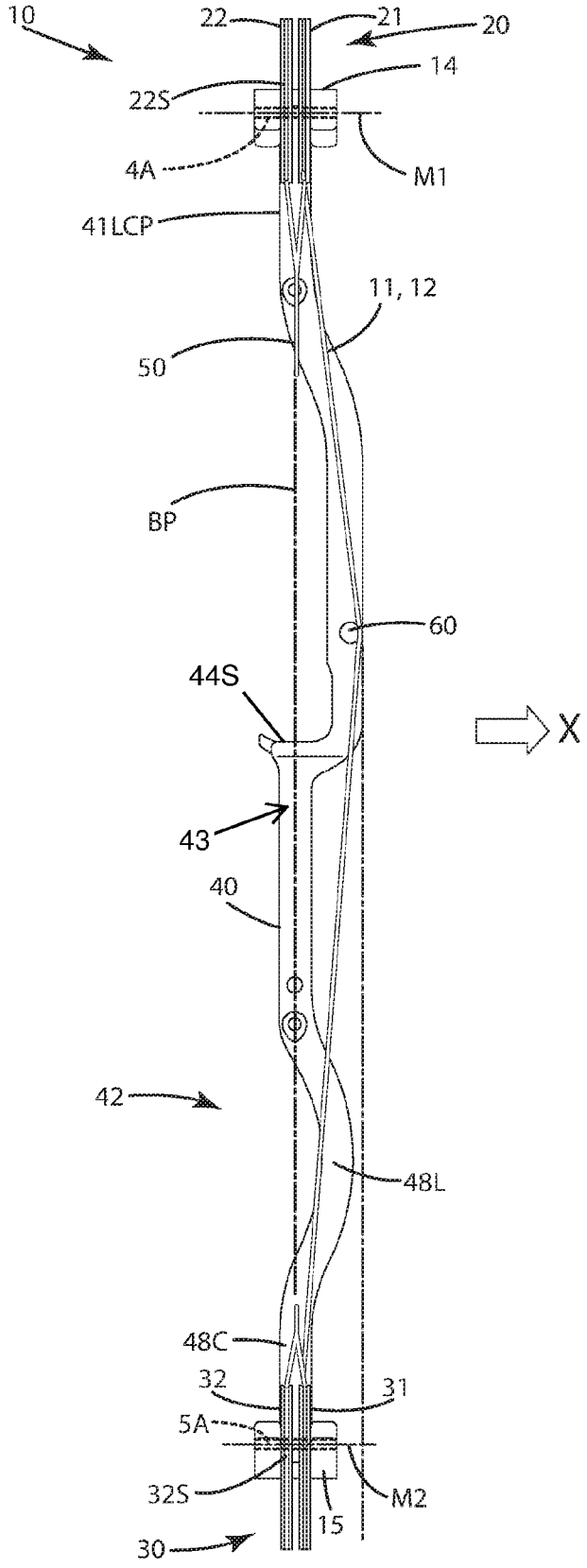
FIG. 3 is a rear view of the archery bow in a brace mode illustrating the distance of upper and lower cams from a reference plane.
Figure 4:
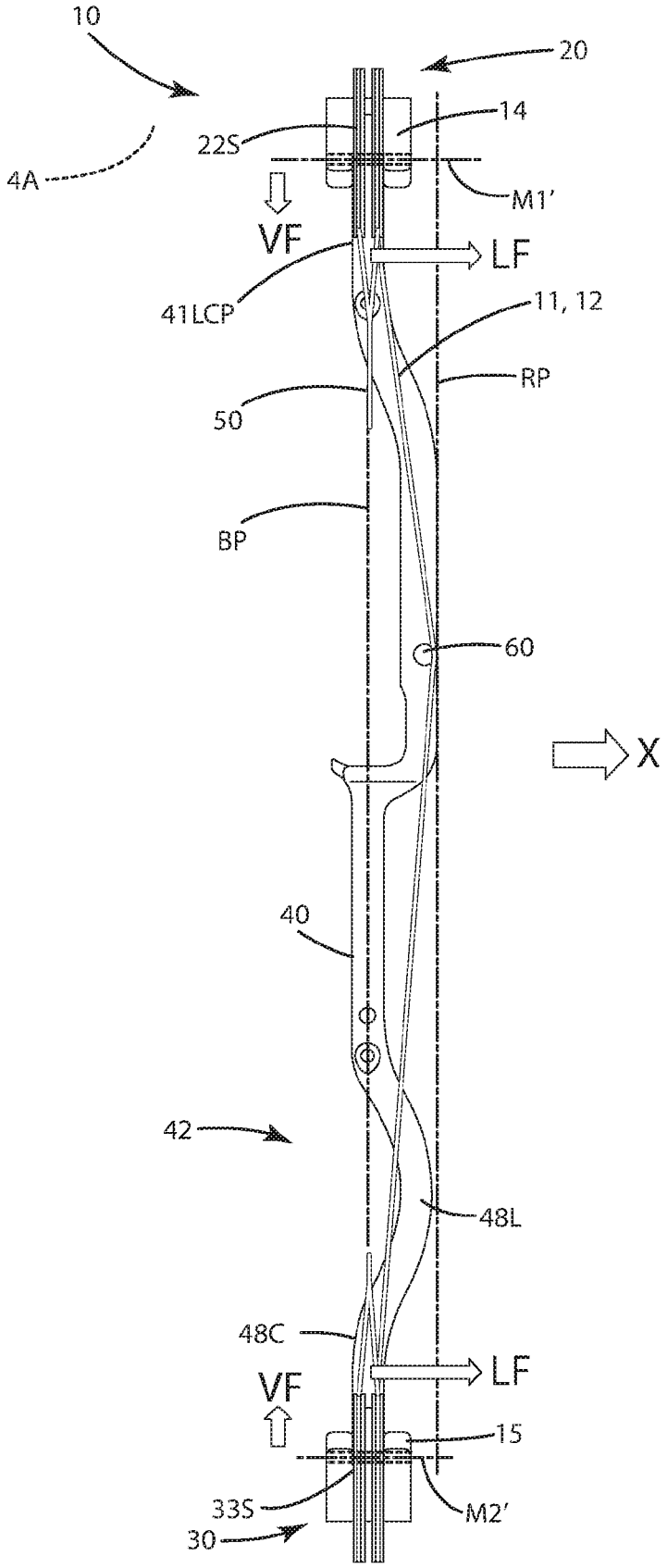
FIG. 4 is a rear view of the archery bow in a drawing or drawn mode illustrating the changed distance of upper and lower cams from a reference plane.

With the offset leg 48L in the lower riser portion 42, the alignment of the upper cam 20 and the lower cam 30, and in particular the respective bowstring tracks 21T, 22T, and 31T, 32T can be maintained and/or minimized with regard to how much these tracks and cams are laterally displaced during a draw cycle and/or a shot cycle. To verify this, an archery bow 10 of the current embodiment was tested as shown in FIGS. 3 and 4. The archery bow had a 60 pound draw weight and a 28 inch draw length. FIG. 3 illustrates the archery bow 10 in a brace mode, with the bowstring 50 being undrawn within the bowstring plane BP. FIG. 4 illustrates the archery bow in a drawn mode, with the bowstring 50 being drawn fully within the bowstring plane BP. Measurements were taken in both the brace mode and the drawn mode to determine the extent of movement of the cams relative to a reference plane RP.

In particular, as shown in FIG. 3, the measurement M1 was taken between the reference plane RP and the upper cam surface 22S which is immediately adjacent the upper axle 4. The measurement was taken there, at surface 22S, to reduce the effect of inherent cam lean on the measurement when the bow is drawn from the brace mode to the drawn mode. Specifically, this location is close enough to the axle 4 that the amount of cam lean in this location is minimized in contrast to taking a measurement at the uppermost portion of the upper cam 20, where cam lean might be noteworthy. The measurement M2 was taken in a similar manner, that is between the reference plane RP and the lower cam surface 32S is immediately adjacent the lower axle 5. Again measurement near the axle reduces the effect of cam lean on the measurement. Both measurements M1 and M2 were taken when the bow was in the brace mode and undrawn as shown in FIG. 3.

The same measurements were again taken as M1' and M2', but after the bow went through a draw cycle and was drawn to the fully drawn mode shown in FIG. 4, in which the bowstring 50 was pulled to its drawn state within the bowstring plane BP. The various forces acting on the cams and riser are illustrated there. For example, when the bow is drawn, the limbs 14, 15 and cams 20, 30 have vertical forces VF exerted upon them by the bowstring and the power cables 11, 12. The power cables, due to their engagement with the cable guard 60, exert lateral forces LF on the cams 20 and 30 as illustrated. This lateral force LF generally causes the upper cam and lower cam to move laterally in the first direction X toward the reference plane RP when the bow 10 is drawn to the drawn mode. This lateral force translates into a torsional force at the ends of the riser 40, that is, the limb connecting portions 41LCP and 48C adjacent the limbs 14 and 15; however, due to the dynamic flexing of the offset in the lower portion 42 of the riser, and in particular, at or near the leg 48L, the cams can maintain alignment, that is, they do not move substantially relative to the reference plane RP.

In particular, the amount of movement of the cams, and the general alignment of those cams, was measured by comparing the measurements in the different modes. For example, to determine the amount of movement of the upper cam from brace to the drawn mode, M1' was subtracted from M1. The upper cam 20 and in particular the upper cam surface 22S moved a first distance in the first direction X toward the reference plane RP. This first distance was 0.054 inches.

To determine the amount of movement of the lower cam from the brace mode to the drawn mode, M2' was subtracted from M2. The lower cam 30 and in particular the lower cam surface 32S moved a second distance in the first direction X toward the reference plane RP. The second distance was 0.049 inches. Accordingly, the second distance, moved by the lower cam toward the reference plane, was less than the first distance moved by the upper cam toward the reference plane RP. Further, the upper and lower cams on the archery bow 10 optionally move almost the same amount, further optionally, an equal amount, when the bow is drawn to the drawn mode.

Comparing measurements of the upper and lower cam movement relative to the reference plane RP with regard to several other conventional bows, it was determined that the bow 10 moved the opposite of those and the conventional bows. For example, the other conventional bows tested all upper cam moving a greater distance relative to the reference plane than the lower cam moving relative to the reference plane. Further, using the same measurement apparatus, in many cases, the conventional bow lower cams moved laterally over 100% more than the cams of the archery bow 10, which was surprising and unexpected.

As one example, a Prime Rize bow, available from G5 Outdoors, LLC of Memphis, Mich., set at a draw weight of 60 pounds and a draw length of 28½ inches, exhibited upper cam movement (M1-M1') of 0.09 inches, and lower cam movement (M2-M2') of 0.147 inches. As another example, a Prime Impact bow, also available from G5 Outdoors, LLC, set at a draw weight of 57 pounds and a draw length of 28.5 inches, exhibited upper cam movement (M1-M1') of 0.062 inches, and lower cam movement (M2-M2') of 0.116 inches. Thus, with these conventional bows, lower cam movement due to the lateral forces LF exerted by the power cables resulted in the lower riser, and thus the lower cam, flexing significantly more than the lower riser portion of the current archery bow 10. Further, it appeared that overall movement of both the upper and lower cams was significantly less in the archery bow 10 of the current embodiments than in the conventional bows tested.

With reference to FIG. 5, the upper cam 20 and lower cam 30 of the archery bow 10 can be specially configured. In particular, the upper and lower cams can be shaped differently. For example, the bow cam parts 21, 22 of the upper cam 20 can be shaped differently and a slightly different size than the bow cam parts 31 and 32 of the lower cam 30. As shown in FIG. 5, the upper cam 20 bowstring cam 21 can include a bowstring track 21T (which can be identical to the bowstring track 22T of the adjacent bowstring cam 22). This bowstring track 21T can include a radius R2 measured from the axis of rotation 4. This radius R2 can remain substantially the same throughout the latter portion of the draw cycle UC. As an example, this radius R2 can be maintained at about optionally 2 inches to about 4 inches, and further optionally about 2.5 inches throughout the latter portion of the draw cycle UC.

In contrast, the lower cam 30 bowstring cam 31 can include a bowstring track 31T (which can be identical to bowstring track 32T of the adjacent bowstring cam 32). This bowstring track 31T can be constructed to change its radius about halfway through the draw cycle. For example the lower bowstring cam track 22T can be disposed a third radius R3 from the axis of rotation 5 of the axle 5A. About halfway through the draw cycle of the lower cam LC, however, this radius changes to a fourth, different radius R4 measured from the axis of rotation 5 of the axle 5A. Thus, the bowstring track 31T of the lower cam changes radius through its draw cycle LC, while the upper cam 20 maintains a constant radius R to throughout the latter portion UC of the draw cycle. These differences, in combination with the structure of the power cable cams, can enhance and provide substantially constant vertical nock travel for enhanced accuracy and consistent arrow flight.

Referring again to FIG. 5, the eccentric upper and lower cams can differ in another way. For example, the upper bowstring track 21T, 22T can be longer than the lower bowstring track 31T, 32T. This difference in the upper and lower bowstring track lengths can facilitate consistent vertical nock travel during the shot cycle, particularly when the center grip riser of the current embodiment is utilized, and the nocking point is above the geometric center line GCL of the riser 40. To provide the desired nocking point travel and payout of the bowstring from the upper and lower cams, the length of the bowstring tracks 21T, 22T and 31T, 32T can be configured to relate to one another in a special ratio.

In particular, the ratio of the length of the bowstring payout track in the lower cam relative to the length of the bowstring payout track in the upper cam can be less than 1:1. In other words, the length of the lower bowstring payout track, that is the part of the bowstring track that pays out a bowstring therefrom during a draw cycle, can be less than the length of the upper bowstring payout track. In some cases the ratio of the length of the bowstring payout track in the lower cam relative to the length of the bowstring payout track in the upper cam is in the range of optionally 1:7 to 1:1.01, further optionally 1:2 to 1:1.1, and even further optionally 1:1.5 to 1:1.1. In other cases the ratio of the length of the bowstring payout track in the lower cam relative to the length of the bowstring payout track in the upper cam is optionally less than 1:1.01, further optionally less than 1:1.1, even further optionally less than 1:1.25, and yet further optionally less than 1:1.5.

In operation, the archery bow 10 having the riser 40 and cam system can function to maintain alignment of the upper and lower cams, and thereby minimize and/or eliminate lateral nock travel. Referring to FIGS. 3 and 4, the archery bow can be drawn from the brace mode shown in FIG. 3 to the drawn mode shown in FIG. 4. In so doing, the drawing of the bowstring 50 rotates the upper 20 and lower 30 cams and associated cam parts. This rotation causes the power cable cams 23, 33 of the upper and lower cams to exert tension on the power cables 11, 12. The power cables are pulled laterally away from the bowstring plane in the direction via the cable guard 60. As shown in FIG. 4, this tension in the power cables 11, 12 results in a lateral force LF exerted on the upper cam 20 and lower cam 30. Both the upper cam and lower cam and dynamically move in direction X toward the reference plane RP due to the lateral forces LF.

With the archery bow 10 of the current embodiment, the upper cam 20 moves laterally toward the reference plane RP a first distance that is greater than or equal to a second distance by which the lower cam moves toward the reference plane. Put another way, the lower cam moves laterally toward the reference plane a second distance that is less than or equal to a first distance by which the upper cam moves toward the reference plane RP. Again in some cases, the upper and lower cams can move by the same distance, or the lower cam moves toward the reference plane RP, or away from the bowstring plane BP, less than the upper cam moves in those directions. In some cases, the first distance and second distance can optionally be less than 0.055 inches, further optionally less than 0.01 inches and even further optionally less than 0.005 inches. Likewise, the upper and lower cams can move similar amounts and distances during the shot cycle, which in turn can reduce and/or eliminate lateral nock travel. Further, during at least a portion of the draw cycle of the archery bow, the bowstring can be paid out with the upper cam 20 faster than the bowstring is paid out with the lower cam 30.

The riser and cam system of the current embodiments also exhibits unique characteristics when the bow is being assembled. For example, the lower riser portion 42 and its offset, bowed out leg 48L react differently than conventional bows when the bow string and power cables are strung about the upper and lower cams. Specifically, the leg 48L is operable in an unstrung mode, in which the bowstring and power cables are not strung to the cams. The leg is also operable in a strung mode, where the bowstring and power cables are strung to the cams. In the on strung mode, the lower cam 30 is located a first offset distance from the reference plane RP associated with an outer lateral upper riser surface 45. This first offset distance corresponds to the bow before the bowstring is strung to extend between the upper and lower cams. In the strung mode, the lower cam 30 is located a second offset distance from the reference plane RP associated with the outer lateral upper riser surface. The second offset distance is greater than the first offset distance. This, in turn, confirms that when the bowstring and power cables are strong to the cams, the lower portion of the riser, and in particular the leg flexes so that the lower cam 20 moves a distance away from the reference plane RP, and generally away from the cable guard when or as the bowstring and cables are strung to the cams and the bow. Again, this is surprising because many conventional bows, such as the Impact and Rise noted above oppositely move toward the reference plane and generally toward the cable guard, when being strung.

Figure 8:
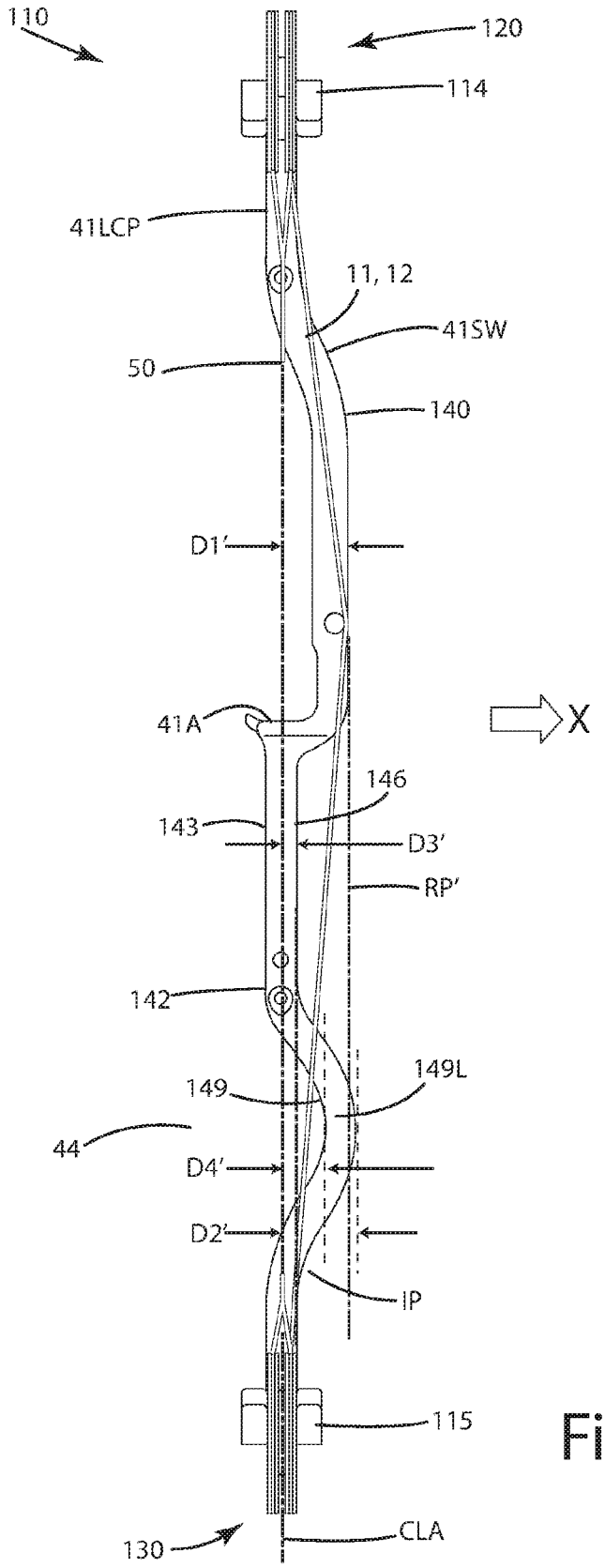
FIG. 8 is a rear view of an alternative embodiment of the archery bow illustrating a more pronounced offset in the lower riser portion of the riser.

A first alternative embodiment of the archery bow and in particular the cam rotation assist device is illustrated in FIG. 8 and generally designated 110. This embodiment is similar to the embodiment described above in structure, function and operation with several exceptions. For example, the archery bow 110 includes a riser 142 which upper cam 120 and lower cam 130 are attached via the limbs 114 and 115. The lower riser portion 142 of this embodiment, however, is slightly different. In particular it includes a leg 149L that is bowed out substantially more than the embodiment above. With this leg 149L, the outer lateral leg surface 147 and its outermost tangential plane LP' is disposed a distance D2' from the central longitudinal axis CLA'. This distance D2' is greater than the distance D1' from which the outer lateral riser portion 145 is disposed from the central longitudinal axis CLA'. For example, the distance D2' can be optionally 0.100 inches, further optionally 0.250 inches, even further optionally 0.500 inches or more greater than distance D1'. Further, the inner lateral leg surface 149 and its tangential plane IP' is disposed a distance D4' from the central longitudinal axis CLA'. This distance D4' is greater than the distance D3' from which the outer grip surface 146 is disposed the central longitudinal axis CLA'. For example, the distance D4' can be optionally 0.100 inches, further optionally 0.250 inches, even further optionally 0.500 inches or more greater than distance D3'. In general, the leg bows out a greater distance than the upper sight window 141SW in the upper portion of the riser, and can extend outward substantially more than the grip 143 in the lateral direction X. Of course, different configurations of the riser leg and cam can be utilized with the current embodiments, depending on the application.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery bow comprising:

a riser including an upper riser portion, a lower riser portion, and a central longitudinal axis, the riser including a reference plane disposed laterally of the central longitudinal axis;

an upper cam joined with an upper limb which is joined with the upper riser portion;

a lower cam joined with a lower limb which is joined with the lower riser portion;

a bowstring joined with the upper and lower cams, the bowstring movable in a bowstring plane;

a power cable joined with the upper and lower cams;

a cable guard joined with the riser, the cable guard configured to laterally displace a portion of the power cable away from the bowstring plane;

wherein the lower riser portion includes a laterally offset portion that is displaced laterally from the central longitudinal axis of the riser an offset distance sufficient to enable the lower riser portion to flex so that when the bow is drawn, and the power cable exerts a lateral force component on the upper and lower cams, the upper cam is configured to move laterally relative to the reference plane a first distance, and the lower cam is configured to move laterally relative to the reference plane a second distance, the first distance being greater than or equal to the second distance, whereby alignment of the upper cam and the lower cam is generally maintained to minimize lateral nock travel.

2. The archery bow of claim 1 wherein the lower cam and the upper cam move laterally in a first direction toward the reference plane when the bow is drawn.

3. The archery bow of claim 2 wherein the upper riser portion and the lower riser portion both extend laterally in a same direction toward the reference plane.

4. The archery bow of claim 1, wherein the upper cam includes an upper axle and the lower cam includes a lower axle, wherein the first distance extends from an upper cam surface adjacent the upper axle to the reference plane, and the second distance extends from a lower cam surface adjacent the lower axle to the reference plane, whereby measurement of the upper cam surface and the lower cam surface adjacent the respective upper and lower axles reduces the effect of cam lean on the measurement of the first distance and the second distance.

5. The archery bow of claim 1, wherein the lower riser portion includes a grip portion adjacent the grip, a leg that extends from a grip of the riser to a limb connecting portion, the leg bowed outward away from the central longitudinal axis, the leg being an only, single structure of the riser connecting the grip portion and the limb connecting portion of the riser.

6. The archery bow of claim 1, wherein the riser includes a grip having an outer grip lateral surface that is spaced a third distance in a first direction from the central longitudinal axis, wherein the riser includes a leg having an inner leg lateral surface that is spaced a fourth distance in the first direction from the central longitudinal axis, wherein the fourth distance is greater than the third distance.

7. An archery bow comprising:

a first cam joined with a first limb;

a second cam joined with a second limb, with a bowstring extending between the first and second cams;

a riser to which the first and second limbs are joined, the riser having a central longitudinal axis, the riser comprising:

a grip;

an upper riser portion extending upwardly from the grip and outward from the central longitudinal axis in a first direction, the upper riser portion including an outer upper lateral surface that is spaced a first distance in the first direction from the central longitudinal axis;

a lower riser portion extending downward from the grip, the lower riser portion including a grip portion adjacent the grip, a leg that extends from the grip portion to a limb connecting portion, the leg bowed outward away from the central longitudinal axis in the first direction, the leg including an outer lower lateral surface that is spaced a second distance in the first direction from the central longitudinal axis, the leg being an only, single structure of the riser connecting the grip portion and the limb connecting portion of the riser, wherein the ratio of the first distance to the second distance is in the range between about 2:1 to about 1:10.

8. The archery bow of claim 7, wherein the ratio of the first distance to the second distance is in the range between about 1.5:1 to about 1:4.

9. The archery bow of claim 7, wherein the grip includes an outer grip lateral surface that is spaced a third distance in the first direction from the central longitudinal axis, wherein the leg includes an inner leg lateral surface that is spaced a fourth distance in the first direction from the central longitudinal axis, wherein the fourth distance is greater than the third distance.

10. The archery bow of claim 7, wherein the leg includes an inner leg lateral surface that is spaced a fourth distance in the first direction from the central longitudinal axis, wherein the leg is bowed outward from the central longitudinal axis so that the inner leg lateral surface at least one of curves and angles outward from the central longitudinal axis, wherein the grip is an only, single structure of the riser joining the upper portion and the lower portion of the riser.

11. The archery bow of claim 7, wherein the upper cam defines an upper bowstring track, wherein the lower cam defines a lower bowstring track, wherein the upper bowstring track is longer than the lower bowstring track.

12. The archery bow of claim 7, wherein the riser includes a geometric centerline located halfway between the first limb and the second limb, the geometric centerline being perpendicular to the central longitudinal axis, wherein the bowstring includes an arrow nocking point, wherein the grip includes a center grip configured to engage an archer's hand in a purlicue between an archer's thumb and forefinger, wherein the center grip is located along the geometric centerline, wherein the nocking point is located above the geometric centerline.

13. The archery bow of claim 7 wherein the upper cam includes a bowstring track that is of a greater length than another bowstring track of the lower cam.

14. A method of using of an archery bow comprising:

providing an archery bow including a riser having a reference plane, upper and lower limbs joined with the riser, an upper cam rotatably joined with the upper limb and a lower cam rotatably joined with the lower limb, and a bowstring and a power cable joined with the upper and lower cams; and drawing the bowstring so that the power cable pulls laterally on the upper and lower cams, but the upper cam moves laterally toward the reference plane a first distance that is greater than or equal to a second distance by which the lower cam moves toward the reference plane.

15. The method of claim 14 wherein the first and second distances are both less than 0.055 inches.

16. The method of claim 14 comprising:

paying out the bowstring with the upper cam faster than paying out the bowstring from the lower cam during at least a portion of a draw cycle of the archery bow.

17. An archery bow comprising:

a riser;

an eccentric upper cam joined with an upper limb which is joined with the riser, the upper cam including a first power cable cam having a first power cable payout track that is contiguous with a first power cable take-up track, the upper cam including a first bowstring payout track having a first length;

an eccentric lower cam joined with a lower limb which is joined with the riser, the lower cam including a second power cable cam having a second power cable payout track that is contiguous with a second power cable take-up track, the lower cam including a second bowstring payout track having a second length;

a bowstring joined with the upper and lower cams and moveable in a bowstring plane;

a power cable joined with the upper and lower cams;

a cable guard joined with the riser, the cable guard configured to laterally displace a portion of the power cable away from the bowstring plane;

wherein the ratio of the second length to the first length is less than 1:1.

18. The archery bow of claim 17, wherein the ratio of the second length to the first length is in the range of 1:2 to 1:1.1.

19. The archery bow of claim 17 wherein the upper cam pays out the bowstring faster than the lower cam pays out the bowstring during at least a portion of a draw cycle of the archery bow.

20. An archery bow comprising:

a first and a second limb to which an upper cam and a lower cam are respectively joined;

a riser to which the first and second limbs are joined, the riser having a central longitudinal axis, the riser configured for use by a right hand dominant archer, the riser being joined with a cable guard, the riser comprising:

a grip;

an upper portion extending upwardly from the grip, the upper portion extending laterally outward to the right of the central longitudinal axis when the riser is viewed from a rear of the bow;

a lower portion extending downward from the grip, the lower portion including a grip portion adjacent the grip, a leg that extends downward from the grip portion to a limb connecting portion, the leg bowed outward to the right of the central longitudinal axis, wherein the leg is operable in an unstrung mode and a strung mode, wherein in the unstrung mode, the lower cam is located a first offset distance from a reference plane associated with an outer lateral upper riser surface, before a bowstring is strung to extend between the upper and lower cams, wherein in the strung mode, the lower cam is located a second offset distance from a reference plane associated with the outer lateral upper riser surface, after a bowstring is strung to extend between the upper and lower cams, wherein the second offset distance is greater than the first offset distance, whereby in reconfiguring from the unstrung mode to the strung mode, the leg flexes so that the lower cam moves away from the reference plane and generally away from the cable guard.

* * * * *